US008513904B2

(12) United States Patent
Weng

(10) Patent No.: US 8,513,904 B2
(45) Date of Patent: Aug. 20, 2013

(54) STEP-DOWN HYSTERETIC CURRENT LED DRIVER IMPLEMENTING FREQUENCY REGULATION

(75) Inventor: Matthew Weng, San Ramon, CA (US)

(73) Assignee: Micrel, Inc., San Jose, CA (US)

( * ) Notice: Subject to any disclaimer, the term of this patent is extended or adjusted under 35 U.S.C. 154(b) by 131 days.

(21) Appl. No.: 13/298,874

(22) Filed: Nov. 17, 2011

(65) Prior Publication Data

US 2013/0127361 A1 May 23, 2013

(51) Int. Cl.
*H05B 37/02* (2006.01)

(52) U.S. Cl.
USPC ..... 315/307; 315/158; 315/224

(58) Field of Classification Search
USPC ..... 315/149, 158, 224, 291, 307
See application file for complete search history.

(56) References Cited

U.S. PATENT DOCUMENTS

| | | | | |
|---|---|---|---|---|
| 8,129,916 | B2 * | 3/2012 | Godbole | 315/225 |
| 8,253,339 | B1 * | 8/2012 | Godbole et al. | 315/149 |
| 2012/0200231 | A1 * | 8/2012 | Esaki et al. | 315/210 |

* cited by examiner

*Primary Examiner* — Don Le
(74) *Attorney, Agent, or Firm* — Van Pelt, Yi & James LLP

(57) ABSTRACT

A step-down hysteretic current LED driver circuit implements frequency regulation to adjust the hysteresis levels of a hysteretic comparator in the control circuit of the LED driver to keep the switching frequency of the inductor current constant. More specifically, the switching frequency of the inductor current is kept constant by increasing or decreasing the hysteresis window of the hysteretic comparator. In this manner, the switching frequency of the LED driver is kept constant or predictable. In one embodiment, the control circuit of the LED driver includes a frequency regulator to monitor the switching frequency and adjusts the hysteresis window accordingly to maintain a constant switching frequency.

8 Claims, 3 Drawing Sheets

$$SP1 = \frac{V_{IN} - V_{LED} - I_{LED} R_{CS}}{L}$$

$$SP2 = \frac{V_{LED} + V_{DFREE} + I_{LED} R_{CS}}{L}$$

STEP-DOWN HYSTERETIC CURRENT LED DRIVER IMPLEMENTING FREQUENCY REGULATION

FIELD OF THE INVENTION

The invention relates to a light-emitting diode (LED) driver circuit and, in particular, to a LED driver circuit implementing frequency regulation.

DESCRIPTION OF THE RELATED ART

Light-emitting diodes (LEDs) have been used as a source of emitted light for a wide variety of applications. LEDs are rapidly replacing incandescent bulbs, fluorescent bulbs, and other types of light sources due to their efficiency, small size, high reliability, and selectable color emission. A typical forward voltage drop for a high power LED is about 3-4 volts. The brightness of an LED is controlled by the current through the LED, which ranges from a few milliamps to an amp or more, depending on the type of LED. For this reason, LED drivers typically include some means to control the LED current.

LED drivers are used to regulate the current delivered to an LED or a string of LEDs or multiple stings of LEDs over a given input voltage range. A step-down hysteretic constant-current LED driver is one type of LED drivers capable of delivering LED currents with high accuracy while operating at high efficiency. FIG. 1 is a circuit diagram of a conventional step-down hysteretic current LED driver. Referring to FIG. 1, an LED driver 1 is configured to drive an LED or a string of LEDs denoted as a diode $D_{LED}$. The LED is connected in series with a current sense resistor $R_{CS}$, an inductor L1 and a switch S1 between an input voltage $V_{IN}$ (node 2) and the ground potential. The switch S1 is open and closed in response to a control signal SW_ON (node 14) generated by a control circuit 10. A switching voltage $V_{SW}$ is thus generated at a node 4 as a result of the opening and closing of switch S1. A freewheeling diode $D_{FREE}$ is connected between the input voltage node 2 and the switching voltage node 4. The control circuit 10 is implemented as a hysteretic comparator 12 which monitors the voltage across the current sense resistor $R_{CS}$ and generates the control signal SW_ON in response.

In operation, when switch S1 is turned on (closed), the inductor L1 is charged up with an inductor current $I_L$. When switch S1 is turned off (open), the inductor current $I_L$ recirculates through the freewheeling diode $D_{FREE}$. The control circuit 10 senses the current flowing through the LED ($D_{LED}$) and the inductor L1 by measuring the voltage drop across the current sense resistor $R_{CS}$. The hysteretic comparator 12 generates the control signal SW_ON for turning the switch S1 on and off to keep the inductor current $I_L$ between two hysteresis levels. When a capacitor is placed across the LED $D_{LED}$, the current through the LED ($I_{LED}$) becomes the average of the inductor current $I_L$.

The conventional LED driver, such as LED driver 1 of FIG. 1, have shortcomings. One particular drawback is that the switching frequency $f_{SW}$ of the inductor current depends strongly on a number of factors. FIG. 2 illustrates the inductor current $I_L$ and switching voltage $V_{SW}$ of the LED driver of FIG. 1 in steady-state operation. When switch S1 is turned on (closed), the switching voltage $V_{SW}$ is shorted to 0V, the inductor current $I_L$ charges up with a positive slope SP1. When switch S1 is turned off (open), the switching voltage $V_{SW}$ transitions to a voltage value being the sum of the input voltage and the voltage across the freewheeling diode $D_{FREE}$ ($V_{SW}=V_{IN}+V_{DFREE}$) and the inductor current $I_L$ decreases with a negative slope SP2.

The slopes of the inductor current $I_L$ during the ON and OFF phases of switch S1 are given as:

$$SP1 = \frac{V_{IN} - V_{LED} - I_{LED}R_{CS}}{L}, \text{ and}$$

$$SP2 = \frac{V_{LED} + V_{DFREE} + I_{LED}R_{CS}}{L}.$$

where $V_{LED}$ denotes the voltage across the LED, $V_{DFREE}$ denotes the voltage across the freewheeling diode $D_{FREE}$, $I_{LED}$ denotes the current flowing through the LED ($D_{LED}$), and L denotes the inductance of inductor L1.

By enforcing volt-second balance for the inductor L1, it can be shown that the switching frequency of the inductor current is related to the hysteresis window $\Delta I_{pp}$ establishes by the hysteretic comparator 12. The hysteresis window $\Delta I_{pp}$ determines the peak-to-peak current swing of the inductor current $I_L$. The switching frequency $f_{SW}$ can be given as:

$$f_{SW} = \frac{(V_{IN} - V_{LED} - I_{LED}R_{CS}) \times (V_{LED} + V_{DFREE} + I_{LED}R_{CS})}{\Delta I_{PP} \times L \times (V_{IN} + V_{DFREE})}.$$

Accordingly, the switching frequency of the inductor current in the LED driver depends on the input voltage $V_{IN}$, the voltage across the LED $V_{LED}$, the inductance L, the voltage across the current sense resistors ($I_{LED}$*$R_{CS}$), and the voltage across the freewheeling diode $V_{DFREE}$. Some of these parameters, particularly the input voltage $V_{IN}$, can vary in the application even during normal operation. As a result, the switching frequency of the inductor current tends to vary even in typical operation. In some applications, a more constant switching frequency is desired.

SUMMARY OF THE INVENTION

According to one embodiment of the present invention, a light-emitting diode (LED) driver circuit configured to receive an input voltage and to supply a current to drive one or more LEDs includes a current sense device coupled between the input voltage and an anode terminal of the LED; an inductor coupled between the cathode terminal of the LED and a first node; a switch coupled between the first node and a ground potential where the switch is controlled by a control signal; a freewheeling diode having an anode terminal connected to the first node and a cathode terminal connected to the input voltage; and a control circuit including a hysteretic comparator configured to receive a sense signal from the current sense device indicative of the current through the LED and to generate the control signal for the switch, the hysteretic comparator comparing the sense signal to a high hysteresis level and a low hysteresis level. A difference between the high and low hysteresis levels defines a hysteresis window. The control circuit further includes a frequency regulator configured to monitor the switching frequency of the control signal and to adjust the hysteresis window of the hysteretic comparator in a way to keep the switching frequency constant.

The present invention is better understood upon consideration of the detailed description below and the accompanying drawings.

DETAILED DESCRIPTION OF THE PREFERRED EMBODIMENTS

In accordance with the principles of the present invention, a step-down hysteretic current LED driver circuit implements frequency regulation to adjust the hysteresis levels of a hysteretic comparator in the control circuit to keep the switching frequency of the inductor current constant. More specifically, the switching frequency of the inductor current is kept constant by increasing or decreasing the hysteresis window of the hysteretic comparator. In this manner, the switching frequency of the LED driver is kept constant or predictable. Keeping the switching frequency of the LED driver constant has the benefit of avoiding injection of audible noise or electric noise which may interfere with surrounding circuitry.

Figure 1:
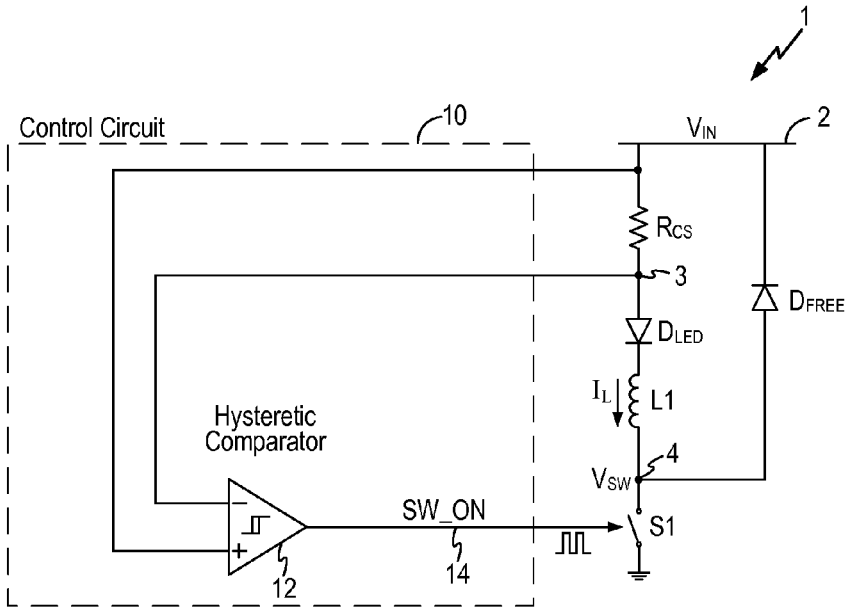
FIG. 1 (Prior Art)
FIG. 1 is a circuit diagram of a conventional step-down hysteretic current LED driver.
Figure 2:
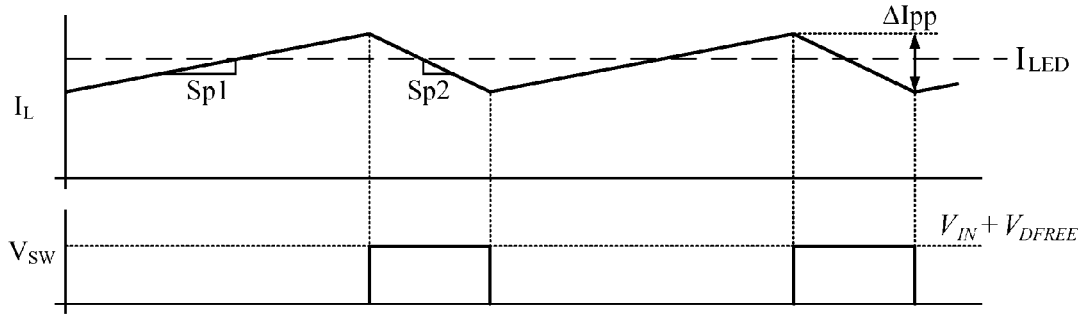
FIG. 2 (Prior Art)
FIG. 2 illustrates the inductor current $I_L$ and switching voltage $V_{SW}$ of the LED driver of FIG. 1 in steady-state operation.
Figure 3:
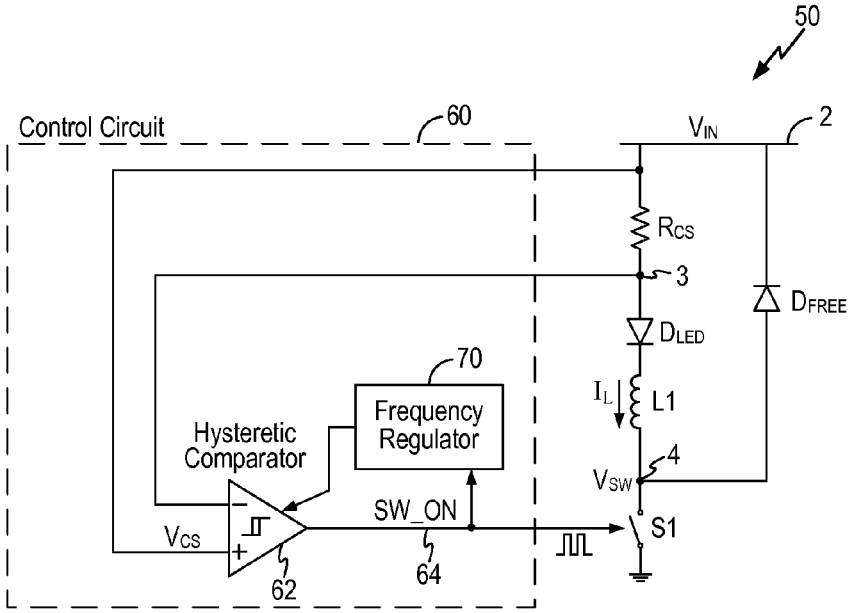
FIG. 3 is a schematic diagram of a step-down hysteretic current LED driver according to one embodiment of the present invention.

FIG. 3 is a schematic diagram of a step-down hysteretic current LED driver according to one embodiment of the present invention. Referring to FIG. 3, an LED driver 50 is configured to drive an LED or a string of LEDs denoted as a diode $D_{LED}$. The LED is connected in series with a current sense resistor $R_{CS}$, an inductor L1 and a switch S1 between an input voltage $V_{IN}$ (node 2) and the ground potential. The LED is connected with the anode terminal connected to the current sense resistor $R_{CS}$ and the cathode terminal connected to the inductor L1. The switch S1 is open and closed in response to a control signal SW_ON (node 64) generated by a control circuit 60. A switching voltage $V_{SW}$ is thus generated at a node 4 as a result of the opening and closing of switch S1. In embodiments of the present invention, the switch S1 is implemented as a MOSFET transistor. A freewheeling diode $D_{FREE}$ has a cathode terminal connected to the input voltage node 2 and an anode terminal connected to the switching voltage node 4. The control circuit 60 senses the current flowing through the LED ($D_{LED}$) and the inductor L1 by measuring the voltage drop across the current sense resistor $R_{CS}$.

According to embodiments of the present invention, the control circuit 60 includes a hysteretic comparator 62 configured to assess the voltage across the current sense resistor $R_{CS}$ and generates the control signal SW_ON in response. The control circuit 60 also includes a frequency regulator 70 configured to monitor the switching frequency of the control signal SW_ON and to regulate the hysteresis window $\Delta I_{pp}$ of the hysteretic comparator 62.

In operation, when switch S1 is turned on (closed), an inductor current $I_L$ builds up in inductor L1. When switch S1 is turned off (open), the inductor current $I_L$ recirculates through the freewheeling diode $D_{FREE}$. The control circuit 60 senses the current flowing through the LED ($D_{LED}$) and the inductor L1 by measuring the voltage drop $V_{CS}$ across the current sense resistor $R_{CS}$. The hysteretic comparator 62 generates the control signal SW_ON for turning the switch S1 on and off to keep the inductor current $I_L$ between two hysteresis levels. When a capacitor is placed across the LED $D_{LED}$, the current through the LED ($I_{LED}$) becomes the average of the inductor current $I_L$.

More specifically, at the hysteretic comparator 62, the voltage $V_{CS}$ is compared to a high hysteresis level and a low hysteresis level. When the voltage $V_{CS}$ increases to the high hysteresis level, indicating a low LED current, the hysteretic comparator 62 transitions the control signal SW_ON to a logical state for closing switch S1. When the voltage $V_{CS}$ decreases to the low hysteresis level, indicating a high LED current, the hysteretic comparator 62 transitions the control signal SW_ON to an opposite logical state for opening switch S1. The high and low hysteresis levels determines the peak-to-peak current swing of the inductor current $I_L$ which is defined as the hysteresis window $\Delta I_{pp}$.

In steady state operation, the switching frequency of the LED driver 50 is determined by the time it takes for the inductor current to reach the high hysteresis level and to decrease to the low hysteresis level. In conventional LED drivers, variations in different parameters of the LED driver circuit, such as the input voltage, may result in the inductor current taking longer or shorter time to reach the high and low hysteresis levels, resulting in variations of the switching frequency of the LED driver.

However, in LED driver 50, the frequency regulator 70 is operative to sense the switching frequency of the LED driver through the control signal SW_ON and the frequency regulator 70 adjusts the hysteresis levels of the hysteretic comparator 62 to obtain a desired switch frequency value. In some embodiments, the frequency regulator 70 adjusts the hysteresis levels of the hysteretic comparator 62 to maintain a constant switching frequency for the LED driver 50. In one embodiment, the frequency regulator 70 adjusts the hysteresis levels of the hysteretic comparator 62 by adjusting the value of the hysteresis window $\Delta I_{pp}$.

In particular, the frequency regulator 70 increases the hysteresis window $\Delta I_{pp}$ to decrease the switching frequency $f_{SW}$ and decreases the hysteresis window $\Delta I_{pp}$ to increase the switching frequency $f_{SW}$. That is, if the switching frequency is too slow and it takes too long for the inductor current to reach the high and low hysteresis levels, the hysteresis window $\Delta I_{pp}$ is decreased so that the inductor current may reach the peak-to-peak current swing faster, thereby increasing the switching frequency. On the other hand, if the switching frequency is too fast and it takes too short a time for the inductor current to reach the high and low hysteresis levels, the hysteresis window $\Delta I_{pp}$ is increased so that the inductor current reaches the peak-to-peak current swing slower, thereby decreasing the switching frequency.

In LED driver 50, the basic relationship between the switching frequency $f_{SW}$ and the hysteresis window $\Delta I_{pp}$ remains the same as in the equation above. The control circuit 60 is capable of keeping the switching frequency constant despite changes in the input voltage $V_{IN}$, the voltage of the LED $V_{LED}$, the inductance value L, the voltage across the current sense resistor $I_{LED}*R_{CS}$, and the voltage across the freewheeling diode $V_{DFREE}$.

In the above-described embodiment, the LED driver 50 uses a current sense resistor $R_{CS}$ to measure the current flowing through the LED $D_{LED}$. The use of the current sense resistor $R_{CS}$ is illustrative only and is not intended to be limiting. In other embodiments of the present invention, other type of current sense devices can be used in the LED driver to measure or sense the current flowing through the LED. The current sense device may generate a sense signal indicative of the current flowing through the LED. For example, a field effect transistor operating in the linear region may be used to measure the LED current. Alternately, the equivalent series resistance (ESR) of an inductor may be used. Furthermore, in embodiments of the present invention, the current sense resistor $R_{CS}$ can be implemented using an integrated resistor of the LED driver or a resistor external to the LED driver integrated circuit. Using an external resistor provides the capability to program the LED current through selection of appropriate resistance value for the current sense resistor $R_{CS}$.

Figure 4:
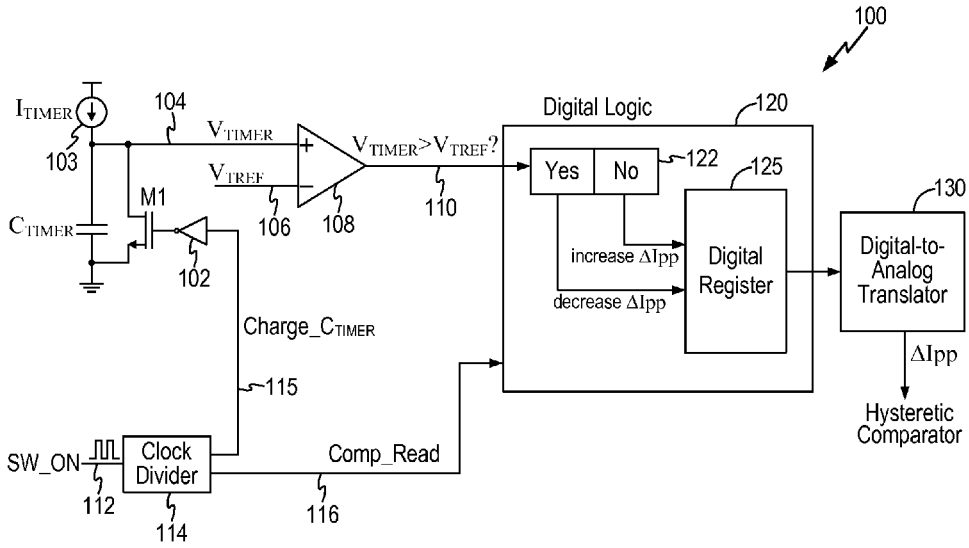
FIG. 4 is a schematic diagram of a frequency regulator which can be incorporated in the LED driver of FIG. 3 according to one embodiment of the present invention.

FIG. 4 is a schematic diagram of a frequency regulator which can be incorporated in the LED driver of FIG. 3 according to one embodiment of the present invention. Referring to FIG. 4, a frequency regulator 100 includes a clock divider 114 receiving the control signal SW_ON on an input node 112. The clock divider 114 counts N cycles of the control signal SW_ON and generates a charging signal "Charge_$C_{TIMER}$" (node 115) for a capacitor $C_{TIMER}$ and also generates a read signal "Comp_Read" (node 116) for a digital logic circuit 120. In one embodiment, the clock divider counts N=4 cycles.

The capacitor $C_{TIMER}$ is coupled to a current source 103 to be charged up with a known current $I_{TIMER}$ for N cycles of the control signal SW_ON. A transistor M1 is coupled across the capacitor $C_{TIMER}$ where the gate of the transistor M1 is controlled by the inverse of the charging signal Charge_$C_{TIMER}$ (node 115). In operation, the Charge_$C_{TIMER}$ signal is asserted and the gate of the transistor M1 is set to a logical low so that transistor M1 is turned off to allow capacitor $C_{TIMER}$ to be charged by the current $I_{TIMER}$. A ramping voltage $V_{TIMER}$ is thus generated at node 104 indicative of the amount of charge stored on the capacitor $C_{TIMER}$.

When the clock divider 114 counted N cycles of the SW_ON signal, the Charge_$C_{TIMER}$ signal is deasserted and the gate of the transistor M1 is set to a logical high to turn on transistor M1. The capacitor $C_{TIMER}$ is then shorted and the capacitor is discharged, resetting the voltage level of voltage $V_{TIMER}$.

The voltage $V_{TIMER}$ is coupled to a comparator 108 to be compared with a reference voltage $V_{TREF}$ (node 106). The output of the comparator 108 is provided to the digital logic circuit 120. Furthermore, the digital logic circuit 120 receives the Comp_Read signal from the clock divider. When the N cycles of the control signal SW_ON have elapsed and before the voltage $V_{TIMER}$ is reset, the Comp_Read signal instructs the digital logic circuit 120 to read the comparator output signal (node 110) from the comparator 108. The comparator output signal has a value indicative of whether the voltage $V_{TIMER}$ is greater than the reference voltage $V_{TREF}$.

In embodiments of the present invention, the digital logic circuit 120 includes one or more registers. In one embodiment, the comparator output signal is stored in a register 122. Furthermore, in embodiments of the present invention, the value of the hysteresis window $\Delta I_{pp}$ is stored in a digital register 125. When the N-cycle charging period has elapsed as indicated by the Comp_Read signal, the digital logic circuit 120 reads and stores the comparator output signal into register 122. The comparator output signal indicates either the voltage $V_{TIMER}$ is greater than the reference voltage $V_{TREF}$ (Yes) or the voltage $V_{TIMER}$ is less than the reference voltage $V_{TREF}$ (No).

If the voltage $V_{TIMER}$ is greater than the reference voltage $V_{TREF}$ (Yes), the digital logic circuit 120 adjusts the value of the hysteresis window $\Delta I_{pp}$ down, that is decreases $\Delta I_{pp}$. If the voltage $V_{TIMER}$ is less than the reference voltage $V_{TREF}$ (No), the digital logic circuit 120 adjusts the value of the hysteresis window $\Delta I_{pp}$ up, that is increases $\Delta I_{pp}$. The digital register 125 stores the updated value of the hysteresis window $\Delta I_{pp}$.

The digital logic circuit 120 provides the updated value for the hysteresis window $\Delta I_{pp}$ to a digital-to-analog translator 130. Digital-to-analog translator 130 converts the digital value to a corresponding analog $\Delta I_{pp}$ value in the hysteretic comparator. The switching frequency of the control signal SW_ON is thereby adjusted by the adjustment made to the value of the hysteresis window $\Delta I_{pp}$. The operation of the frequency regulator 100 is such that the switching frequency $f_{SW}$ is regulated so that the voltage $V_{TIMER}$ becomes approximately equal to the reference voltage $V_{TREF}$ after the N cycles of the control signal SW_ON have elapsed. In this manner, the frequency regulator 100 adjusts the hysteresis window $\Delta I_{pp}$ in the hysteretic comparator of the control circuit of the LED driver to maintain a constant switching frequency of the control signal SW_ON.

Figure 5:
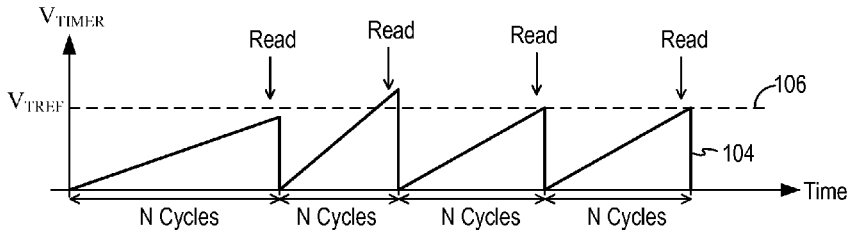
FIG. 5 illustrates the voltage waveform for voltage $V_{TIMER}$ in operation of the frequency regulator of FIG. 4 according to one embodiment of the present invention.

FIG. 5 illustrates the voltage waveform for voltage $V_{TIMER}$ in operation of the frequency regulator of FIG. 4 according to one embodiment of the present invention. Referring to FIG. 5, the voltage $V_{TIMER}$ (curve 104) is a ramping voltage waveform reset at every N cycles of the control signal SW_ON. When the switching frequency of the control signal SW_ON varies, the amount of time for N cycles to elapse varies. In the N-cycle duration of time, the voltage $V_{TIMER}$ may be not be charged up to the reference voltage $V_{TREF}$ (curve 106) if the frequency is too slow, or the voltage $V_{TIMER}$ may exceed the reference voltage $V_{TREF}$ (curve 106) if the frequency is too high. The frequency regulator 100 operates to adjust the hysteresis window $\Delta I_{pp}$ of the hysteretic comparator so that the N-cycle duration of time is just sufficient to allow the voltage $V_{TIMER}$ to charge up to the reference voltage $V_{TREF}$.

In embodiments of the present invention, the digital-to-analog translator 130 is implemented as a control circuit for turning on or off a bank of current sources for setting the value of the hysteresis window $\Delta I_{pp}$. In other embodiments, the digital-to-analog translator 130 is implemented as a digital-to-analog converter. Other methods for implementing the digital-to-analog translator 130 are possible. It is only important that the digital-to-analog translator 130 takes the digital value of the hysteresis window $\Delta I_{pp}$ and converts it to an appropriate analog value for use by the hysteretic comparator.

The frequency regulator 100 shown in FIG. 4 is illustrative only and other implementations of the frequency regulator 100 are possible within the scope of the present invention. For instance, in the present embodiment, a capacitor $C_{TIMER}$, a current source 103 and a transistor M1 are used as a voltage charging circuit to generate the voltage $V_{TIMER}$ for every period of N cycles of the control signal SW_ON. In other embodiments, other configurations for a voltage charging circuit to generate the voltage $V_{TIMER}$ for every N cycles of the control signal SW_ON may be used. For example, an NMOS transistor M1 is used in the present implementation to reset the voltage $V_{TIMER}$. In other embodiments, another switch circuit may be used. Also, inverter 102 is used to convert the charging signal from the clock divider to the proper logical state for controlling transistor M1. Inverter 102 is optional and may be omitted if conversion of signal polarity is not needed.

The above detailed descriptions are provided to illustrate specific embodiments of the present invention and are not intended to be limiting. Numerous modifications and variations within the scope of the present invention are possible. The present invention is defined by the appended claims.

I claim:

1. A light-emitting diode (LED) driver circuit configured to receive an input voltage and to supply a current to drive one or more LEDs, the LED driver circuit comprising:

a current sense device coupled between the input voltage and an anode terminal of the LED;

an inductor coupled between the cathode terminal of the LED and a first node;

a switch coupled between the first node and a ground potential, the switch being controlled by a control signal;

a freewheeling diode having an anode terminal connected to the first node and a cathode terminal connected to the input voltage; and a control circuit comprising a hysteretic comparator configured to receive a sense signal from the current sense device indicative of the current through the LED and to generate the control signal for the switch, the hysteretic comparator comparing the sense signal to a high hysteresis level and a low hysteresis level, a difference between the high and low hysteresis levels defining a hysteresis window, the control circuit further comprising a frequency regulator configured to monitor the switching frequency of the control signal and to adjust the hysteresis window of the hysteretic comparator in a way to keep the switching frequency constant.

2. The LED driver circuit of claim 1, wherein the frequency regulator increases the hysteresis window to decrease the switching frequency and decreases the hysteresis window to increase the switching frequency.

3. The LED driver circuit of claim 1, wherein the switch comprises a MOSFET transistor.

4. The LED driver circuit of claim 1, wherein the frequency regulator comprises:

a clock divider configured to receive the control signal and to count N cycles of the control signal, the clock divider configured to generate a first output signal and a second output signal when N cycles of the control signal have elapsed;

a voltage charging circuit configured to charge a first voltage value for N cycles of the control signal, the voltage charging circuit resetting the first voltage value in response to the first output signal;

a comparator configured to compare the first voltage value to a reference voltage value and to generate a comparator output signal;

a digital logic circuit configured to receive the comparator output signal and to assess the comparator output signal in response to the second output signal, the digital logic circuit comprising a digital register storing a digital hysteresis window value, the digital logic circuit configured to increase the digital hysteresis window value when the first voltage value is less than the reference voltage value and to decrease the digital hysteresis window value when the first voltage value is greater than the reference voltage value; and a digital-to-analog translator configured to convert the digital hysteresis window value to a value for the hysteresis window in the hysteretic comparator.

5. The LED driver circuit of claim 4, wherein the voltage charging circuit comprises:

a current source providing a constant current;

a first capacitor coupled between the current source and the ground potential, a top plate of the capacitor providing the first voltage value; and a switch connected in parallel with the capacitor, the switch being controlled by a signal indicative of the first output signal, wherein the switch is open to enable the first capacitor to be charged by the constant current of the current source and the switch is closed in response to the first output signal to short the first capacitor and to reset the first voltage value.

6. The LED driver circuit of claim 4, wherein the digital-to-analog translator comprises a control circuit for turning on or off a bank of current sources, the bank of current sources setting the value of the hysteresis window in the hysteretic comparator.

7. The LED driver circuit of claim 5, wherein the switch comprises a MOS transistor.

8. The LED driver circuit of claim 1, wherein the current sense device comprises a current sense resistor and the sense signal comprises a voltage across the current sense resistor indicative of the current through the LED.

* * * * *